US006126293A

United States Patent [19]

Wu

[11] Patent Number: 6,126,293

[45] Date of Patent: Oct. 3, 2000

[54] ILLUMINATING UMBRELLA HAVING RELIABLE CONNECTING WIRES FOR MULTIPLE FOLDS

[76] Inventor: Tsun-Zong Wu, 8F, No. 76, Lane 103, Nei-Hu Road, Sec. 2, Taipei 104, Taiwan

[21] Appl. No.: 09/314,196

[22] Filed: May 17, 1999

Related U.S. Application Data

[63] Continuation-in-part of application No. 09/157,464, Sep. 18, 1998, Pat. No. 6,089,727.

[51] Int. Cl.[7] ..... A45B 3/02

[52] U.S. Cl. ..... 362/102; 135/910

[58] Field of Search ..... 362/102, 234, 362/253; 135/910

[56] References Cited

U.S. PATENT DOCUMENTS 5,502,624 3/1996 Tu ..... 362/102

5,611,614 3/1997 Morgan ..... 362/102

5,954,417 9/1999 Mai ..... 362/102

*Primary Examiner*—Stephen Husar

[57] ABSTRACT

An illuminating umbrella includes a top illuminator fixed on a top end of an umbrella central shaft, a plurality of tip illuminators respectively fixed on a plurality of tips of the umbrella ribs of two or multiple folds; each illuminator having a positive wire electrically connected to a positive conducting ring secured on an upper notch of the central shaft, and having a negative wire electrically connected to a negative conducting ring formed on the upper notch of the central shaft, with the positive conducting ring electrically connected to a positive pole of a power source, and the negative conducting ring electrically connected to the negative pole of the power source through an on-off switch, having a safely protected and reliably connected electrical circuit provided among the illuminators and the power source; and a flasher connected between the power source and the illuminators for flashing the illuminators.

20 Claims, 14 Drawing Sheets

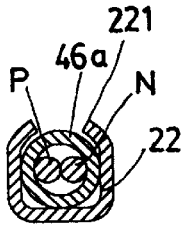
FIG. 2
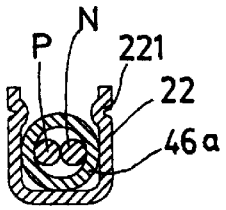
FIG. 3
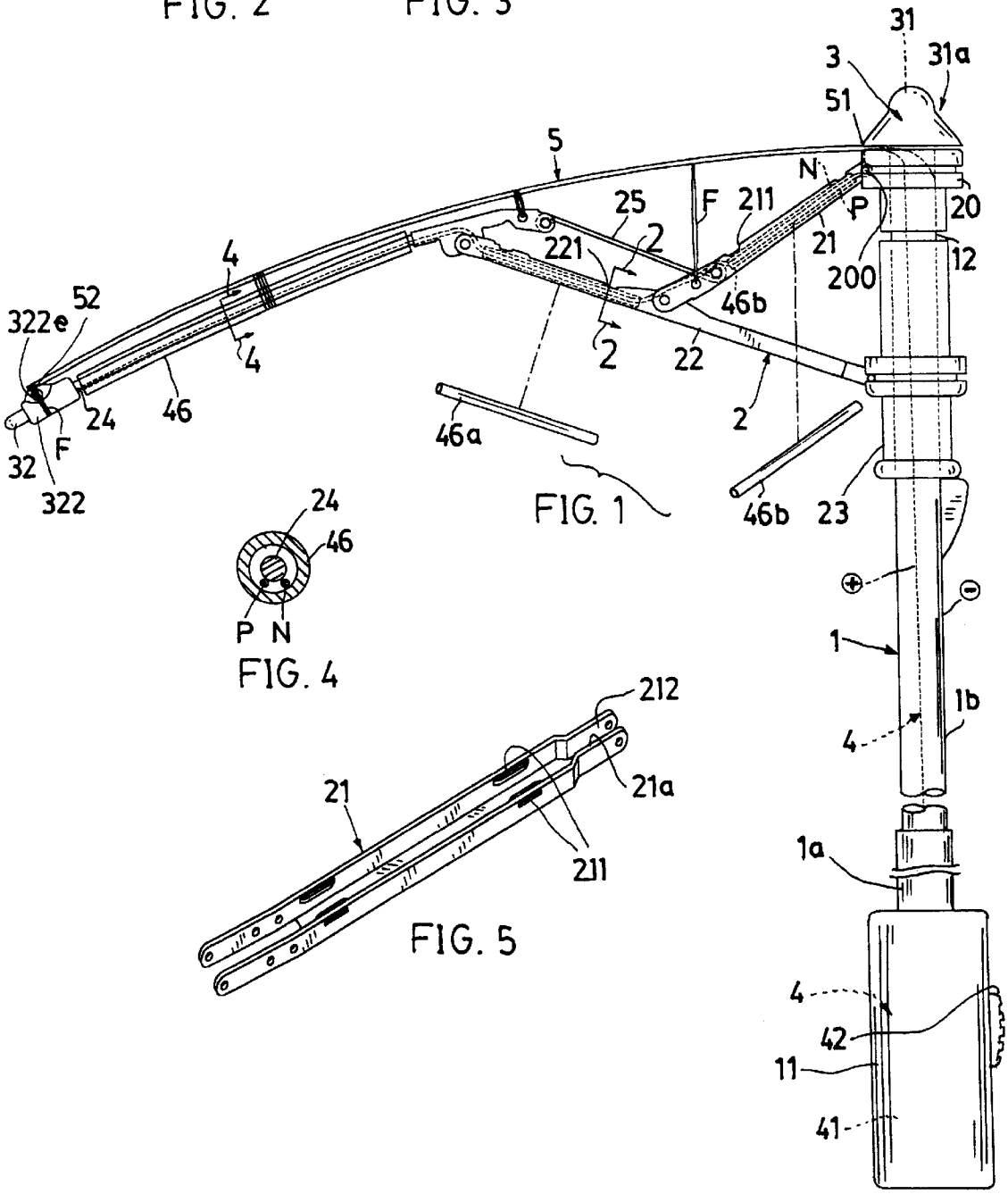
FIG. 1
FIG. 4
FIG. 5

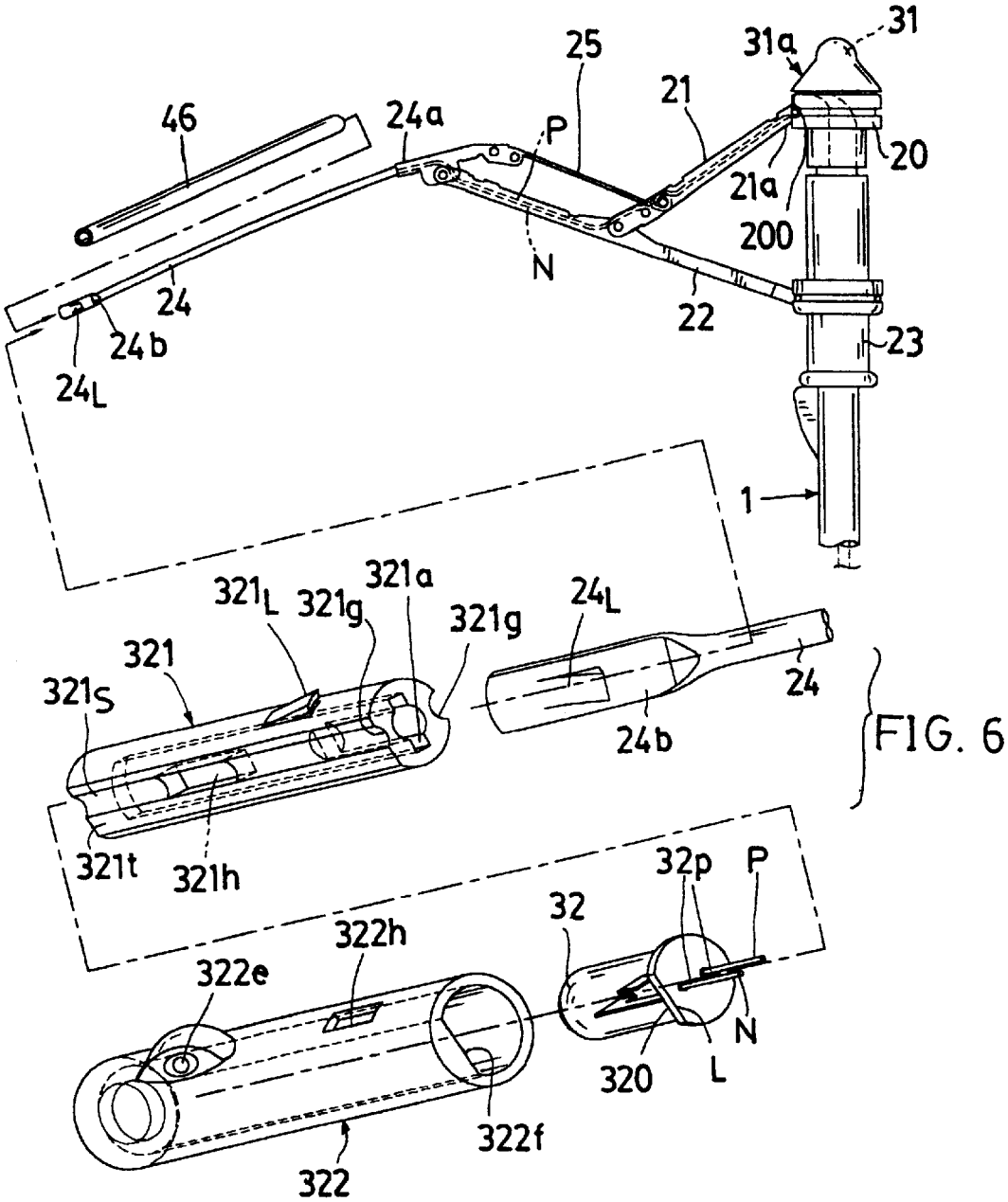
FIG. 6
FIG. 7
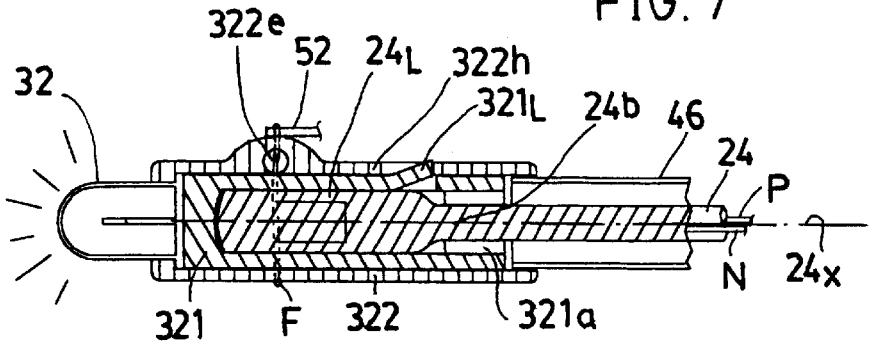

ILLUMINATING UMBRELLA HAVING RELIABLE CONNECTING WIRES FOR MULTIPLE FOLDS

This application is a second Continuation-In-Part of U.S. patent application of Ser. No. 09/157,464 filed on: Sep. 18, 1998 now U.S. Pat. No. 6,089,727 by the same inventor of this application.

BACKGROUND OF THE INVENTION

Original application (U.S. Ser. No. 09/157,464) discloses an illuminating umbrella having a top illuminator fixed on the top of the umbrella shaft and a plurality of tip illuminators fixed on the tips of the umbrella ribs. However, when it is provided for a two-fold umbrella as shown in FIGS. 17, 18 of the original application, the positive and negative wires P, N as suspended from the outer rib (24) towards the upper notch (20) may still be tangled or easily broken during the folding or opening operation of the umbrella. Meanwhile, the power supply system among the illuminators and the power source is still not satisfactory and can be improved for a reliable power connection, while not causing a complex and costly illuminating umbrella.

SUMMARY OF THE INVENTION

The object of the present invention is to provide an illuminating umbrella including a top illuminator fixed on a top end of an umbrella central shaft, a plurality of tip illuminators respectively fixed on a plurality of tips of the umbrella ribs of two or multiple folds; each illuminator having a positive wire electrically connected to a positive conducting ring secured on an upper notch of the central shaft, and having a negative wire electrically connected to a negative conducting ring formed on the upper notch of the central shaft, with the positive conducting ring electrically connected to a positive pole of a power source, and the negative conducting ring electrically connected to the negative pole of the power source through an on-off switch, having a safely protected and reliably connected electrical circuit provided among the illuminators and the power source; and a flasher connected between the power source and the illuminators for flashing the illuminators.

BRIEF DESCRIPTION OF THE DRAWINGS

FIG. 1 is an illustration of the present invention showing the rib assembly and the wire connection thereof.

FIG. 2 is a cross sectional drawing of the present invention when viewed from 2—2 direction of FIG. 1.

FIG. 3 shows another method for securing the wires in the umbrella rib as modified from FIG. 2.

FIG. 4 is a cross sectional drawing when viewed from 4—4 direction of FIG. 1.

FIG. 5 is a perspective view of the top rib.

FIG. 6 is an exploded view of the tip illuminator and the rib assembly of the present invention.

FIG. 7 is a sectional drawing of the tip illuminator as assembled from FIG. 6.

DETAILED DESCRIPTION

Figure 8:
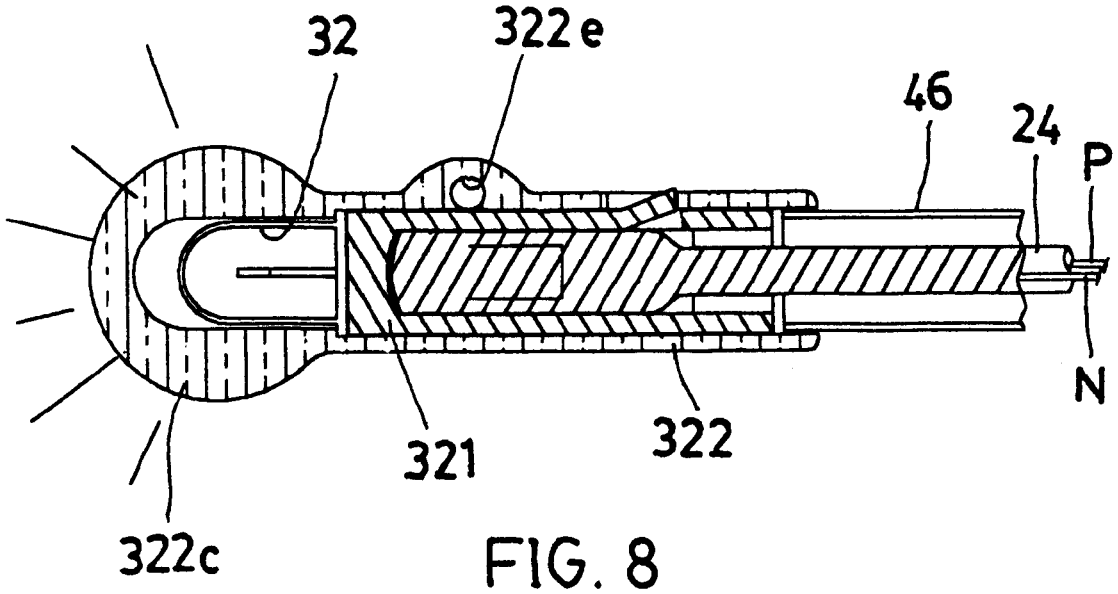
FIG. 8 is a modification of the tip illuminator from FIG. 7.

As shown in FIGS. 1~16, the present invention comprises: a central shaft 1 having a lower tube 1*a* and an upper tube 1*b* telescopically engageable each other, and a grip 11 formed on a lower portion of the lower tube 1*a;* a rib assembly 2 having at least a top rib 21 pivotally secured to an upper notch 20 fixed on a top portion 12 of the shaft 1, a stretcher rib 22 pivotally secured to the top rib 21 and a lower runner 23 slidably held on the shaft 1, an outer rib 24 pivotally connected with the stretcher rib 22 and connected with a connecting rib 25 which is pivotally secured to the top rib 21; an illuminating means 3 including a top illuminator 31 which may be a bulb or a light-emitting diode (LED) fixed on a top end of the shaft 1 and a plurality of tip illuminators 32 each fixed on a tip end (or outer end) of each outer rib 24 and each tip illuminator 32, which may be a light-emitting diode (LED), parallelly electrically connected to a power source; and a power supply means 4 for powering the illuminators 31, 32. An umbrella cloth 5 is provided to cover the rib assembly 2, having an inner cloth portion 51 secured to the upper notch. Several fastening threads F are provided for securing the cloth 5 on the rib assembly. The present invention is provided for a two fold or multiple-fold umbrella.

Figure 9:
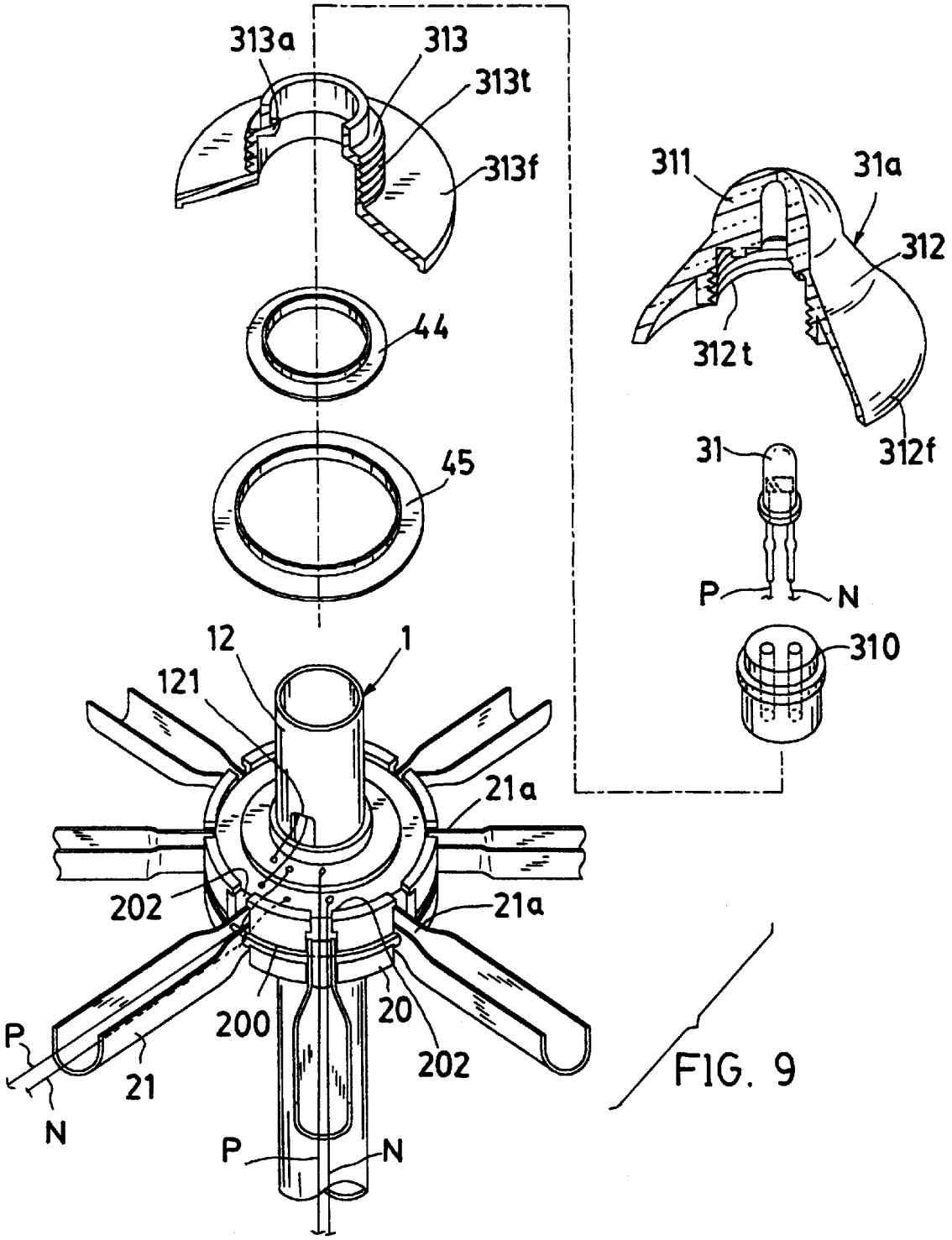
FIG. 9 is an exploded view of the top illuminator and its cap means.
Figure 10:
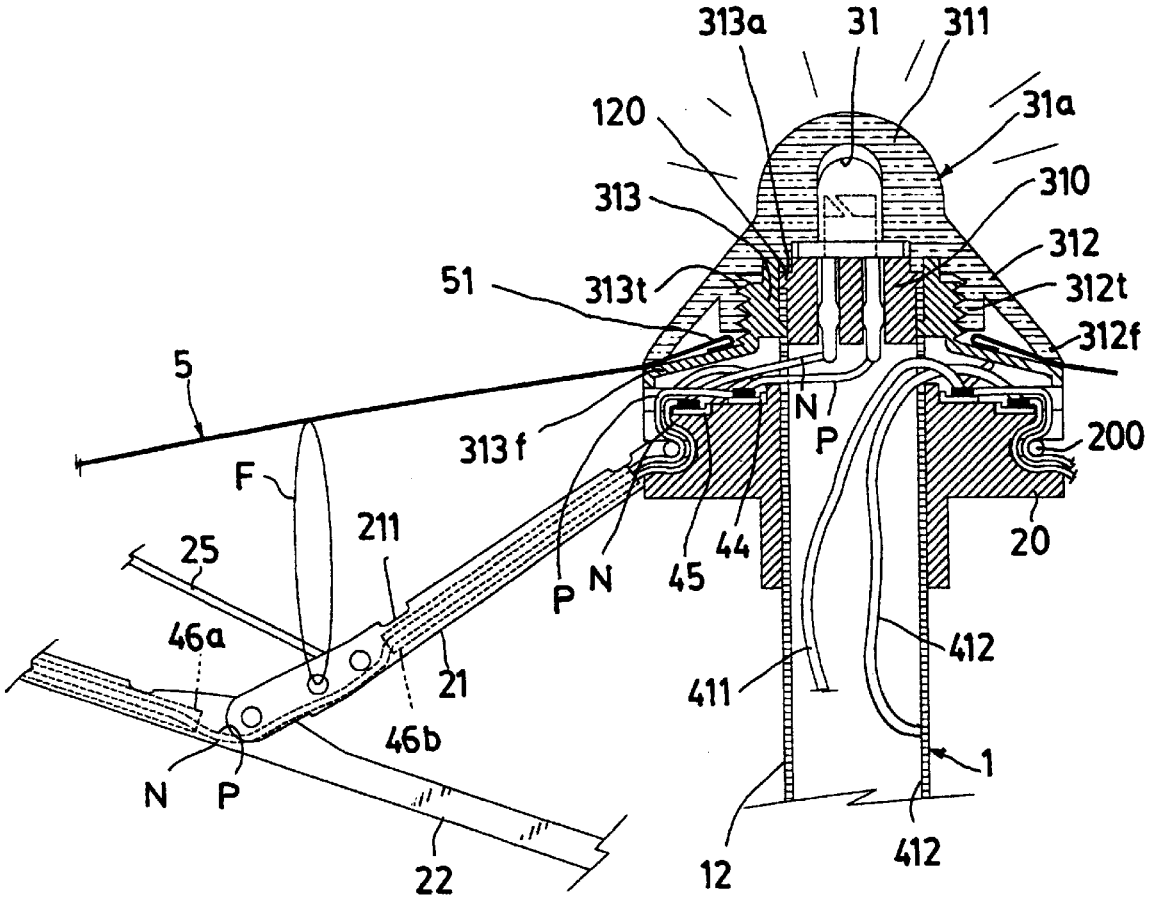
FIG. 10 is a partial sectional drawing of the top portion of the present invention when opened.

The top illuminator 31 has a positive wire P electrically connected to a positive conducting ring 44 embedded or fixed on an inner peripheral portion of the upper notch 20 which may be made of electrically insulative material, and a negative wire N electrically connected to a negative conducting ring 45 embedded or fixed on an outer peripheral portion of the upper notch 20 (FIGS. 9, 10). The wires P, N may be led from the top illuminator 31, through a slot 121 cut through the shaft 1, to the rings 44, 45. The top illuminator 31 has its illuminator holder 310 fixed on a top of the shaft 1.

Each tip illuminator 32 has a positive wire P electrically connected to the positive conducting ring 44, and a negative wire N electrically connected to the negative conducting ring 45, both wires P, N being disposed within each of plural protective tubes such as a PVC tube, including an outer tube 46 having the outer rib 24 disposed therein, a middle tube 46*a* clamped in the U-shaped stretcher rib 22, and an inner tube 46*b* clamped within the top rib 21 having a cross section of U shape, having at least a pair of crimping edges 211, 221 bent inwardly from rib 21, 22 for clamping the protective tube 46, 46*a* within the top rib 21 and the stretcher rib 22 as shown in FIG. 1~4. The crimping edge 221 may be modified as that as shown in FIG. 3.

Each positive or negative wire should be covered (or integrally formed) with electrically insulative sheath. The positive and negative wires P, N as disposed in the outer tube 46 are juxtapositioned to the outer rib 24 (FIGS. 1,4).

The positive and negative wires P, N of each tip illuminator 32 are led through the tubes 46, 46*a*, 46*b* within the ribs, then inwardly protruded through an inner hole 212 bifurcated or formed in an inner portion 21*a* of the top rib 21 to be wound around a fastening wire 200 annularly fastened on the upper notch 20 and to pass through an electric-wire slot 202 formed in the upper notch 20, and then respectively connected to the positive and negative conducting rings 44, 45 such as by soldering or other connection methods.

The positive or negative wire P, N is wound about the fastening wire 200 on the upper notch 20, without obstructing the pivotal motion of the ribs 21 about the fastening wire 200 to prevent or minimize the twisting, tangling, bending, stretching or even breaking of the positive and negative wires P, N.

So, the present invention is provided for a more reliable stable electric-wire connection to be better than the original application.

The positive conducting ring 44 is electrically connected to the positive pole of the power source 41(FIGS. 10, 13), which may be a battery or batteries stored in the grip 11 made of electrically insulative material, through an externally insulated positive conductor 411, 411*a* passing through a hole formed through the shaft and through an interior in the central shaft 1; while the negative conducting ring 45 electrically connected to the negative pole of the power source 41 through a negative conductor 412 which is served by the central shaft 1 including the upper tube 1*b* and the lower tube 1*a* telescopically engageable and electrically conductive with each other.

Between the power source 41 and the two conducting rings 44, 45, a flasher 43 and an on-off switch 42 are electrically connected therebetween. The on-off switch 42 is slidably held on the grip 11 for switching on (or off) the power source 41 for actuating (or deactivating) the flasher 43 which may be an integrated circuit for intermittently turning on the illuminators 31, 32 for flashing purpose.

As shown in FIGS. 13~16, the positive conductor 411 is connected with a coiled positive conductor 411*a*, which is also externally insulated, telescopically wound in the lower tube 1*a* having a plug 1*c* plugged in a lower end of the upper tube 1*b* for retaining the upper end of the coiled positive conductor 411*a*, with the coiled positive conductor 411*a* electrically connected to the positive pole of the power source through the flasher 43.

Figures 13, 14:
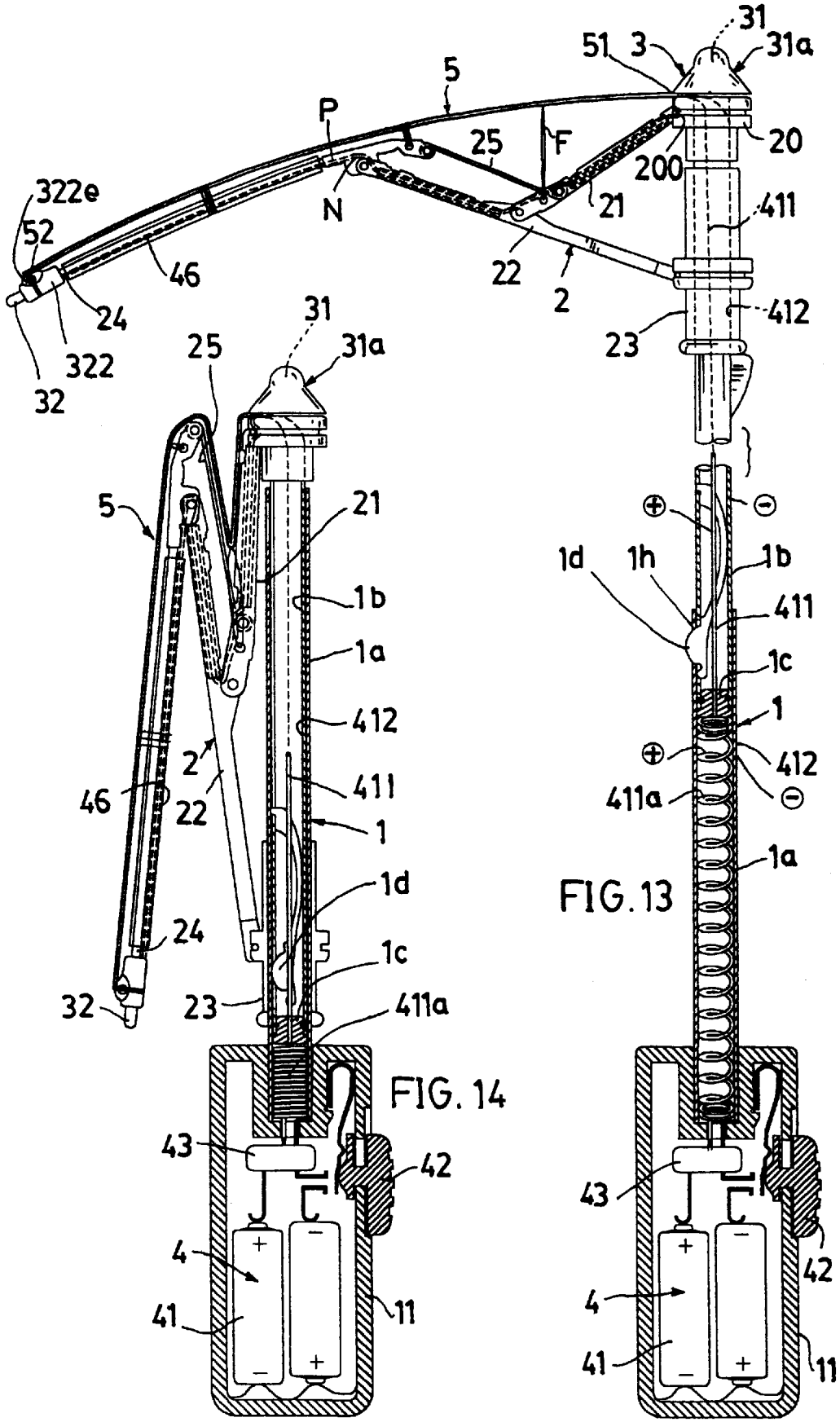
FIG. 13 shows the umbrella of the present invention when opened.
FIG. 14 shows a folded or closed umbrella from FIG. 13.
Figure 15:
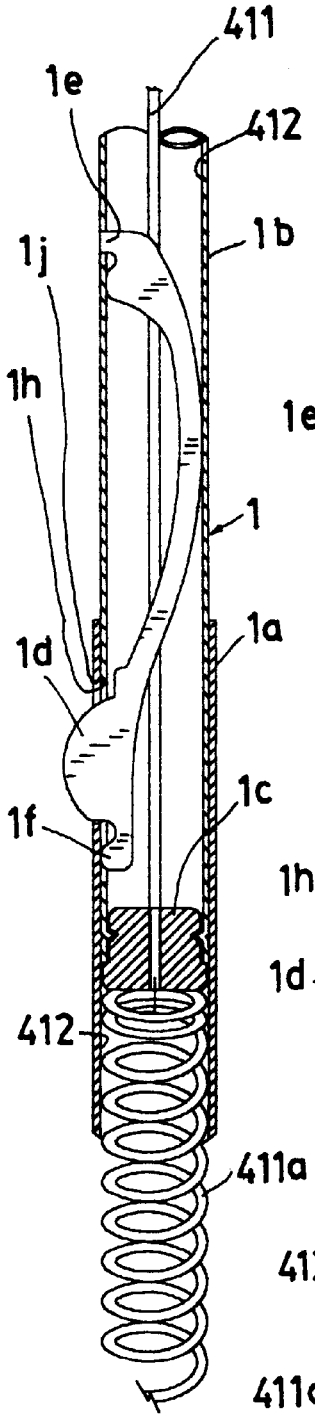
FIG. 15 shows a partial portion of the central shaft as shown in FIG. 13.
Figure 16:
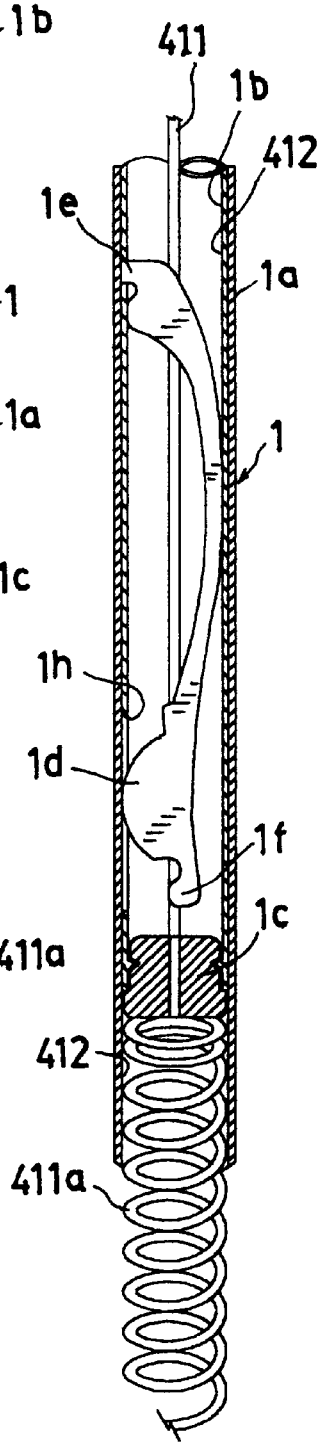
FIG. 16 shows the partial portion of the shaft as shown in FIG. 14.

The shaft 1 includes a coupling spring catch 1*d* made of electrically conductive material and having an upper end 1*e* secured to a lower portion of the upper tube 1*b*, and a lower hook end 1*f* bent outwardly to contact the lower tube 1*a* through a catch hole 1*h* formed in the upper tube 1*b* when the upper tube 1*b* is upwardly extended and coupled with the lower tube 1*a* when opening the umbrella as shown in FIGS. 15, 13 as coupled by the coupling spring catch 1*d* protruding outwardly through the catch holes 1*h*, 1*j* respectively formed in the upper tube 1*b* and the lower tube 1*a*, thereby ensuring a continuous electrical connection between the upper tube 1*b* and the lower tube 1*a* and completing the negative conductor 412 as formed by the upper and the lower tubes 1*b*, 1*a*.

A cap means 31*a* as provided on a top of the shaft 1 as shown in FIGS. 9, 10 includes: a transparent top cover 311 encasing the top illuminator 31 having an intermediate cap portion 312 protruding downwardly from the transparent top cover 311 and having a lower flange 312*f* formed on a bottom portion of the cap portion 312; and a base member 313 having brackets 313*a* formed thereon to be engaged with the bracket hole 120 formed through the shaft 1 to be firmly secured on the shaft 1 and having a male-threaded portion 313*t* engaged with a female-threaded portion 312*t* of the cap portion 312 and having a bottom flange 313*f* of the base member 313 engaged with an outer rim of the upper notch 20 for encasing the positive and negative conducting rings 44, 45 in between the upper notch 20 and the bottom flange 313*f* of the base member 313, with the bottom flange 313*f* of the base member 313 and the lower flange 312*f* of the cap portion 312 cooperatively clamping an inner cloth portion 51 of the umbrella cloth 5 between the two flanges 313*f*, 312*f* of the base member 313 and the cap portion 312 (FIG. 10) for enhancing the water proof effect of the umbrella.

Figure 12:
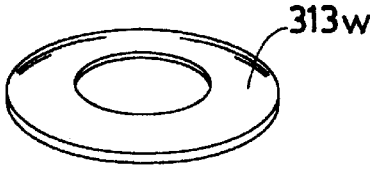
FIG. 12 shows the base washer as shown in FIG. 11.
Figure 11:
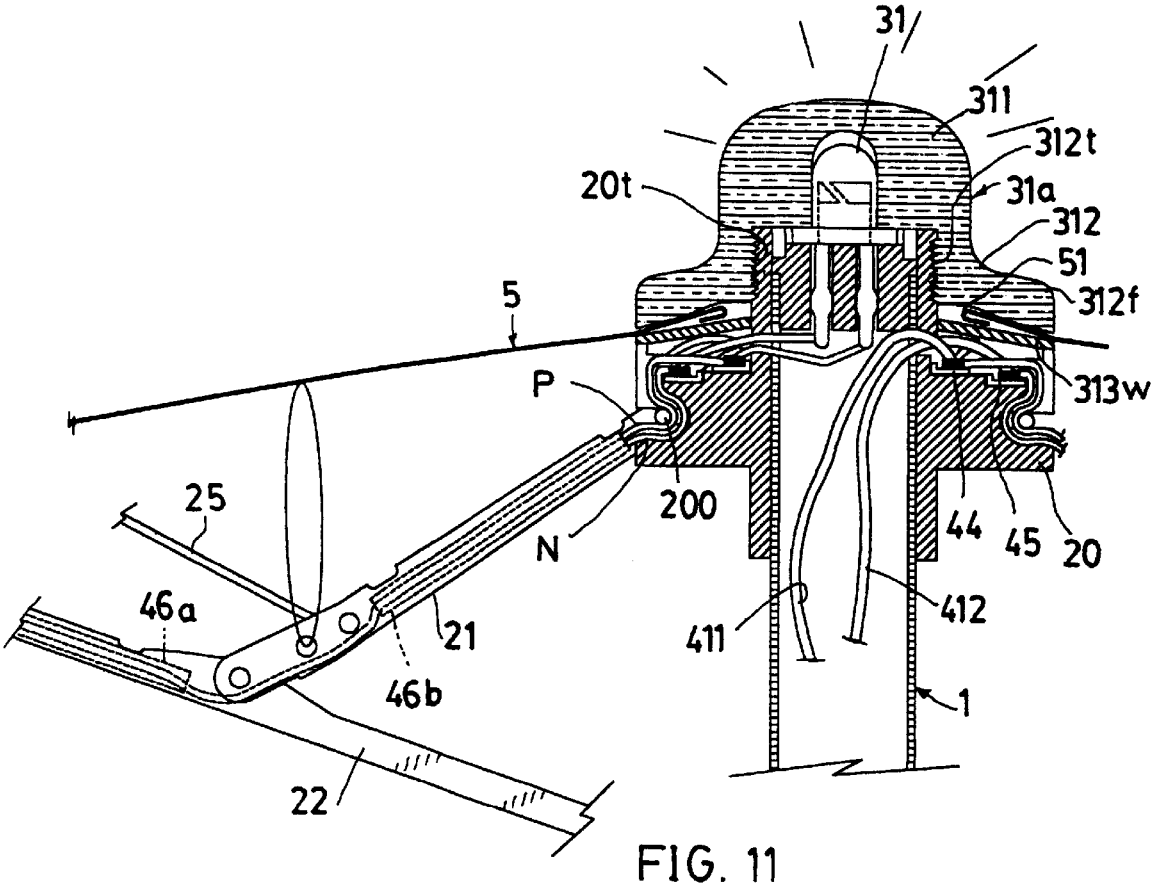
FIG. 11 is a modification from that as shown in FIG. 10.

Or, the base member 313 is modified to be a base washer 313W as shown in FIGS. 11, 12 to be engaged with the lower flange 312*f* of the cap portion 312. The female-threaded portion 312*t* of the cap portion 312 is now engaged with the male-threaded portion 20*t* formed on the upper notch 20.

Each tip illuminator 32 has a pair of pins 32*p* protruding from an illuminator base 320 to be plugged in a socket 321*s* of a tip holder 321 and connected with the positive and negative wires P, N led from the protective tube 46 which encase the outer rib 24 therein (FIGS. 1, 6, 7); with the tip holder 321 coupled to an outer end portion 24*b* of the outer rib 24 and with the tip holder 321 coupled to a tip sleeve 322 for further protecting the tip illuminator 32 and for securing an outer portion 52 of the umbrella cloth 5 on the tip sleeve 322.

The tip holder 321 includes: a rib hole 321*a* formed in the tip holder 321 for inserting the outer end portion 24*b* of the outer rib 24 into the rib hole 321*a*, a slot 321*h* formed in the tip holder to be engaged with a rib lug 24L formed on the outer rib 24, a holder lug 321L formed on the tip holder 321 to be engaged with a sleeve slot 322*h* formed in the tip sleeve 322, a flat portion 321*t* longitudinally formed on a circumference of the tip holder 321 to be engaged with a secant through hole 322*f* longitudinally formed through the tip sleeve 322 and a pair of grooves 321*g* parallelly recessed in opposite sides of the tip holder 321 for embedding the positive and negative wires P, N in the two grooves as led from the protective tube 46.

The tip sleeve 322 has the secant through hole 322*f* engaged with the flat portion 321*t* of the tip holder 321 and also engaged with a flat edge portion (FIG. 6) formed on the illuminator base 320 of the tip illuminator 32 for preventing twisting of the tip illuminator 32, the tip holder and the tip sleeve when coupled together.

The tip sleeve 322 also includes a transparent end cover 322*c* for encasing the tip illuminator 32 (FIG. 8).

The tip sleeve 322 has a top hole 322*e* formed in a top portion of the tip sleeve 322 eccentrically deviated from a longitudinal axis 24*x* of the outer rib 24 as shown in FIG. 7 for firmly securing the umbrella cloth 5 on the tip sleeve 322 by fastening a thread F through the top hole 322*e* (FIGS. 1, 7).

Figure 18:
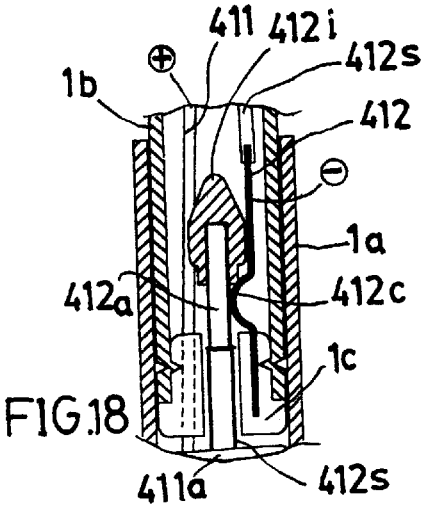
FIG. 18 is a partially enlarged illustration of the electrical connection in the shaft as shown in FIG. 17.
Figure 19:
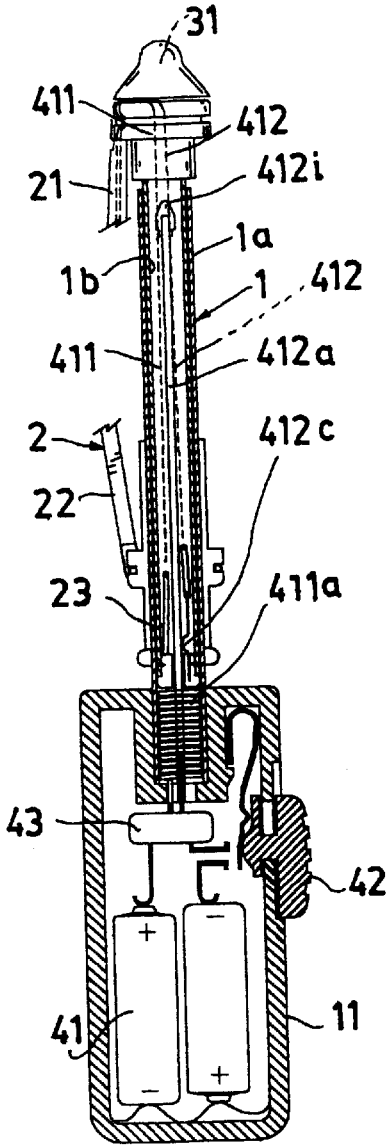
FIG. 19 shows the folded umbrella when closed from FIG. 17.
Figure 17:
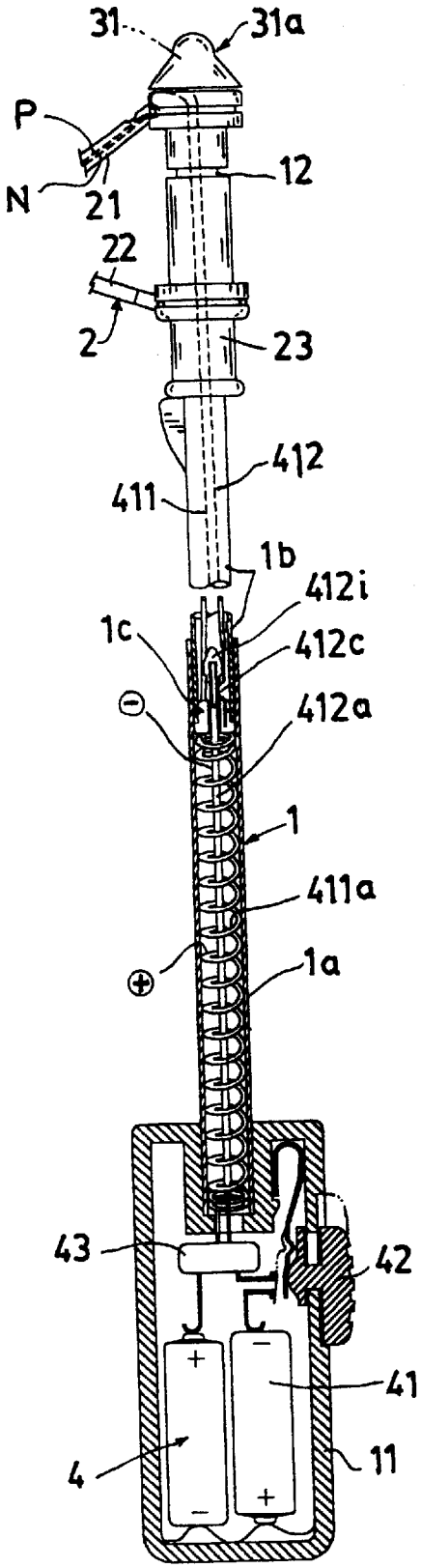
FIG. 17 shows an opened umbrella of the present invention when the central shaft is made of electrically insulative aluminum alloy.

As shown in FIGS. 17~19, the aforementioned negative conductor 412 is formed by using the tubes 1*a*, 1*b* of the central shaft 1 to be the negative conductor. However, if the central shaft 1 is made of anodized aluminum alloy, it will not be electrically conductive. So, besides the positive conductor 411 in an upper portion of the shaft 1 connected with a coiled positive conductor 411*a* held in the lower tube 1*a* of the shaft 1, the negative conductor 412 as formed in an upper portion of the shaft 1 is slidably contacted with a lower rod negative conductor 412*a* electrically connected to the negative pole of the power source 41 through the on-off switch 42.

The negative conductor 412 and the lower rod negative conductor 412*a* are respectively covered with electrically insulative sheath 412*s*, having an electrically conductive top end portion formed on a top end of the lower rod negative conductor 412*a* adjacent a top insulative head portion 412*i* and electrically conducted with a hook end 412*c* formed on a bottom end of the negative conductor 412 (FIG. 18) when the umbrella is opened and the upper tube 1*b* of the shaft 1 is upwardly extended above and stably coupled with the lower tube 1*a* (the head portion 412*i* limiting the hook end 412*c*), thereby completing the electrical connection among the power source and the illuminators through the positive conductors 411, 411*a* and the negative conductors 412, 412*a*.

So, this application provides a reliable electrical connection even under a sliding movement of the upper tube 1*b* and the lower tube 1*a* of the shaft, having better improvement over the original application.

Figure 28:
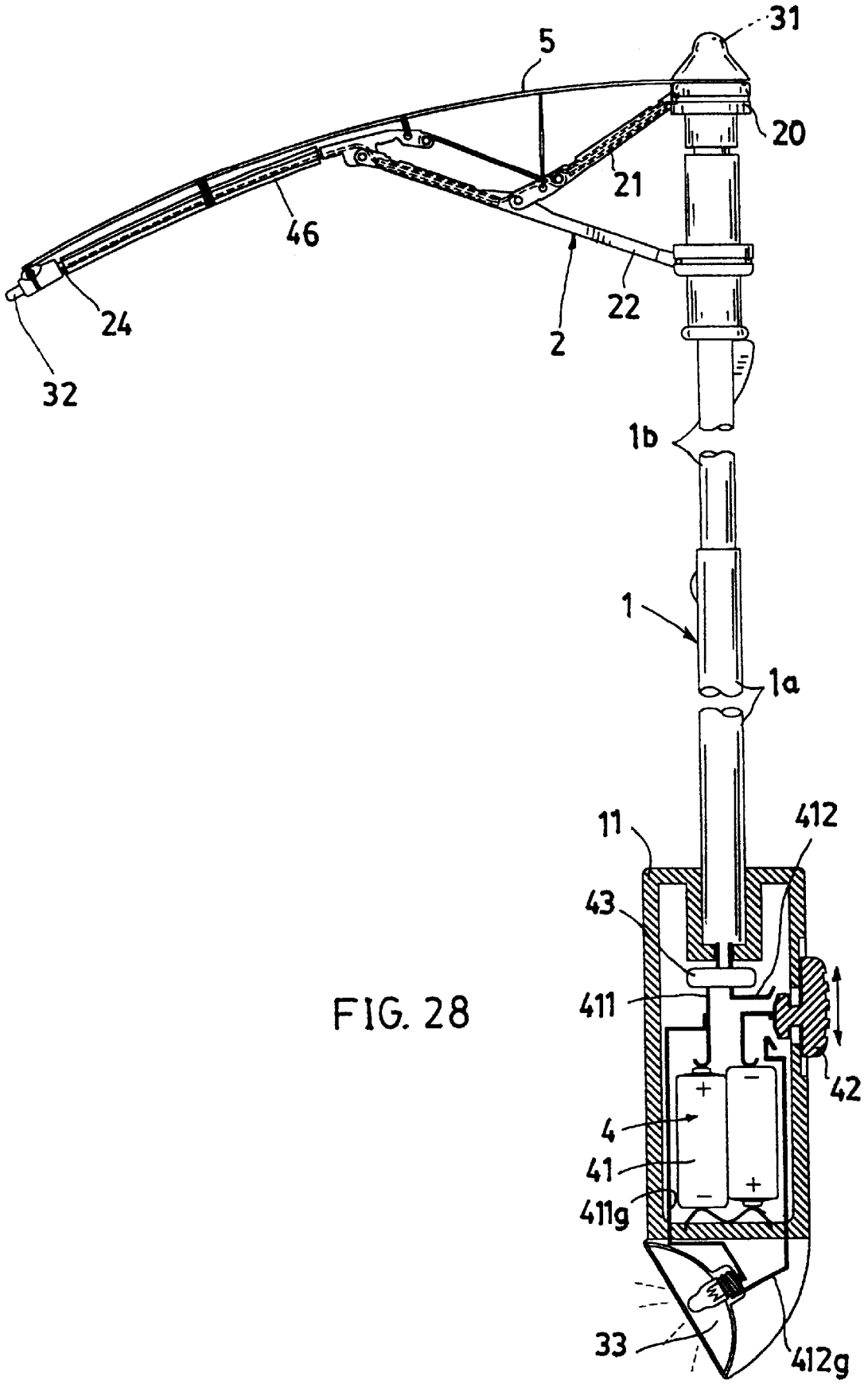
FIG. 28 shows still further preferred embodiment of the present invention.

As shown in FIG. 28, a grip illuminator 33 is further provided in the grip 12, with the grip illuminator 33 respectively electrically connected to a positive pole of the power source 41 of the power supply means 4 through a positive conducting wire 411*g*, and electrically connected to a negative pole of the power source 41 through a negative conductive wire 412*g*, having a pair of contactors formed across the negative conducting wire 412*g*, whereby upon closing of the pair of contactors on the negative conducting wire 412*g* by the on-off switch 42, the grip illuminator 33 will be powered and lit.

The aforementioned conducting rings 44, 45 are now modified to be a printed-circuit-board (PCB) disk 40 disposed on the top portion of the upper notch 20 having at least a positive conducting ring concentrically formed on a the PCB disk 40 for connecting a positive wire P of each illuminator, and having a negative conducting ring concentrically formed on the PCB disk 40 for connecting a negative wire N of each illuminator.

Figure 21:
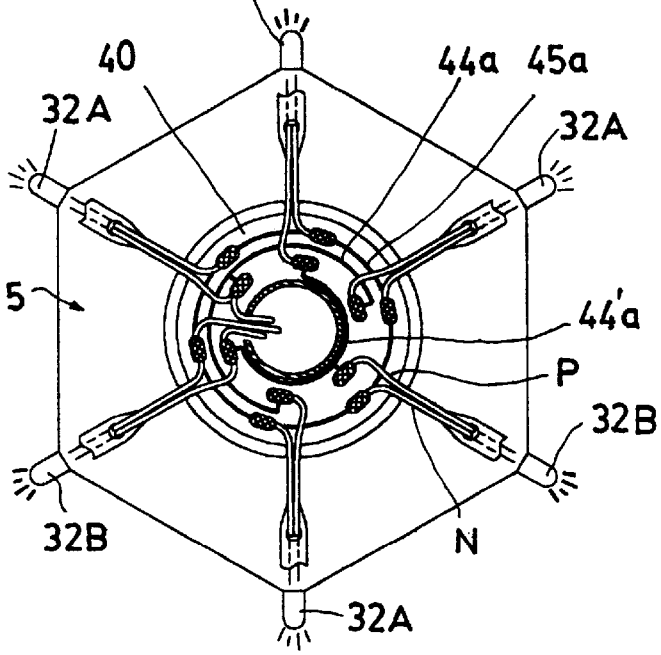
FIG. 21 is a top view of the preferred embodiment as shown in FIG. 20.
Figure 22:
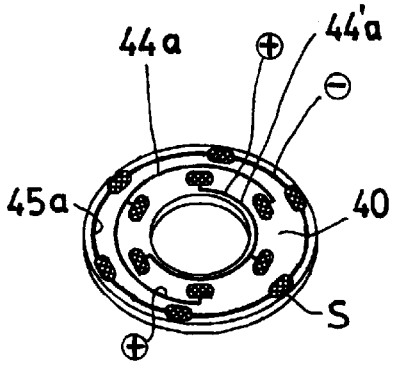
FIG. 22 shows a printed-circuit-board (PCB) disk for connecting the wires as shown in FIG. 21.
Figure 20:
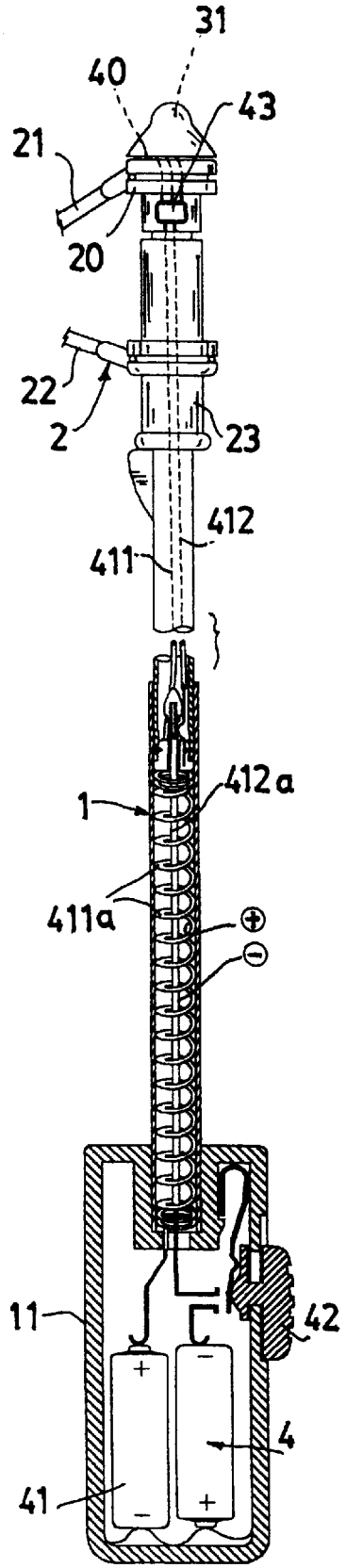
FIG. 20 shows another preferred embodiment of the present invention having the flasher 43 formed in an upper portion of the shaft.

As shown in FIGS. 20~22, two groups of tip illuminators 32A, 32B are alternatively flashed, including a first group of tip illuminators 32A having a positive wire of the first-group tip illuminator 32A connected (by soldering S) to a first positive conducting ring 44*a* concentrically formed on a printed-circuit-board (PCB) disk 40 disposed on the upper notch 20 and a negative wire of the first-group tip illuminator 32A connected (by soldering) to a negative conducting ring 45*a* concentrically formed on the PCB disk 40; and a second group of tip illuminators 32B having a positive wire of the second-group tip illuminator 32B connected to a second positive conducting ring 44'*a* concentrically formed on the PCB disk 40 and a negative wire of the second-group tip illuminator 32B connected to the negative conducting ring 45*a*.

The PCB disk 40 will greatly simplify the production and assembly for the conducting rings 44, 45 of this invention. The number of groups of the flashing tip illuminators 32 are not limited in this invention. The power supply circuit of the embodiment as shown in FIG. 20 may be referred to that as shown in FIG. 17, but removing the flasher 43 from the grip 11 (FIG. 17) to the upper portion of the shaft (20).

Figure 23:
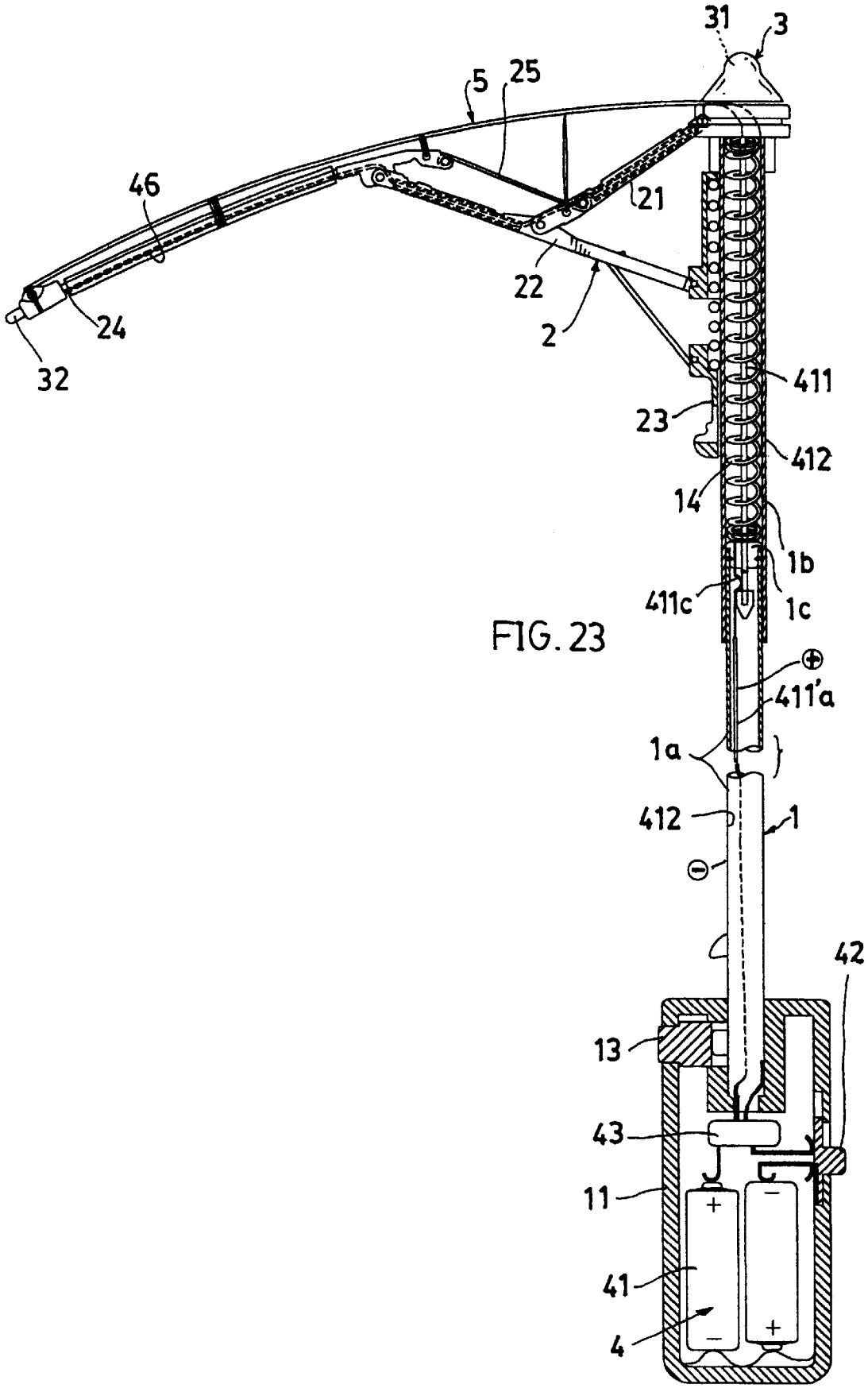
FIG. 23 shows an opened automatic umbrella as modified from the aforementioned.

As shown in FIG. 23, the umbrella is an automatic umbrella having an opening spring 14 retained in the shaft 1 and a push button 13 depressible for opening the umbrella, in which the negative conductor 412 is the same as that shown in FIG. 13, and the positive conductor 411 as externally insulative is however slidably contacted with a lower rod positive conductor 411'*a* which is externally insulative and is electrically connected to the positive pole of the power source 41, having a top hook end 411*c* of the lower rod positive conductor 411'*a* electrically contacted with an electrically conductive bottom end of the positive conductor 411 adjacent to a bottom insulative head portion 411*i* formed on a bottom of the positive conductor 411.

Figure 25:
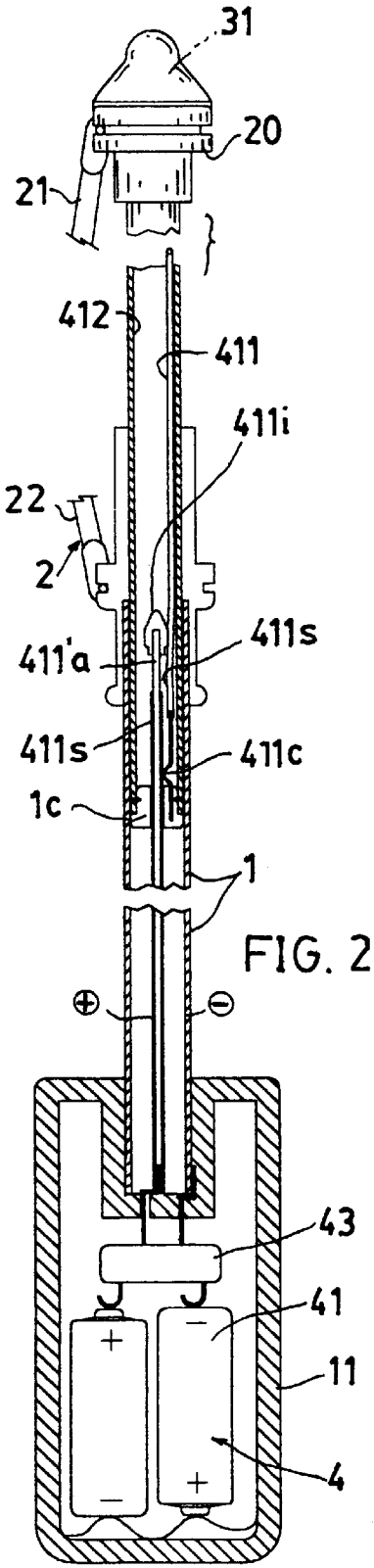
FIG. 25 shows the folded umbrella as closed from FIG. 24.
Figure 24:
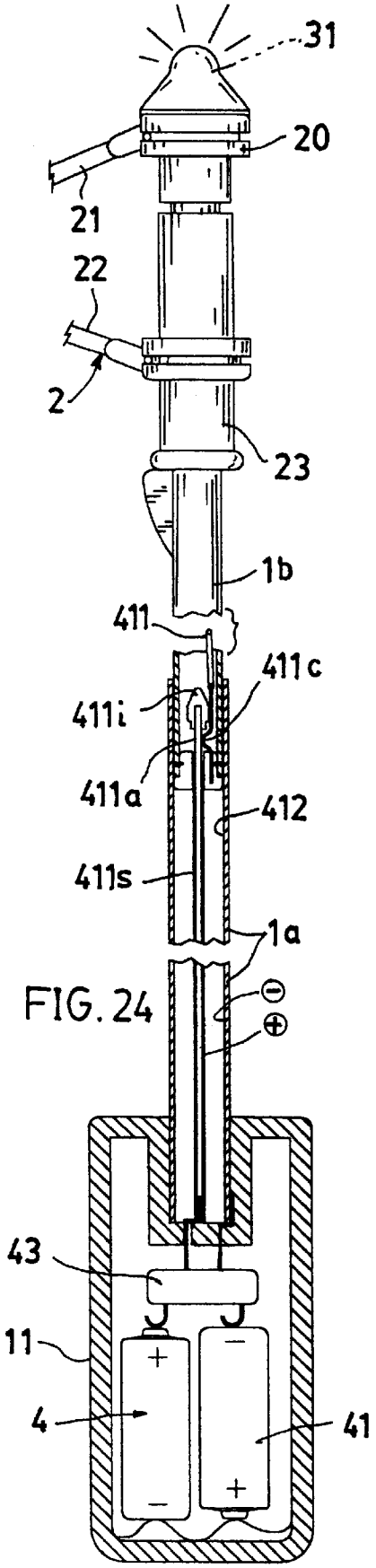
FIG. 24 shows still another preferred embodiment of the present invention when opened.

As shown in FIGS. 24, 25, the on-off switch 42 is removed or eliminated from the grip 11 of the shaft 1, and the on-off switch is modified to be an automatic switch which is actuated to turn on the illuminators when the umbrella is opened (FIG. 24), or actuated to turn off the illuminators when the umbrella is closed (FIG. 25).

The positive conductor 411 as externally insulative is slidably contacted with the lower rod positive conductor 411'*a* also externally insulative, with a hook end 411*c* formed on a bottom end of the positive conductor 411 electrically contacted with an electrically conductive top end of the lower rod positive conductor 411'*a* adjacent a top insulative head portion 411*i* formed on a top end of the lower rod positive conductor 411'*a*. The negative conductor 412 is formed in situ on the shaft 1. Upon opening of the umbrella as shown in FIG. 24, the power supply circuit is closed to light the illuminators 31, 32 for a safe illumination in a dark rainy day.

Figures 26, 27:
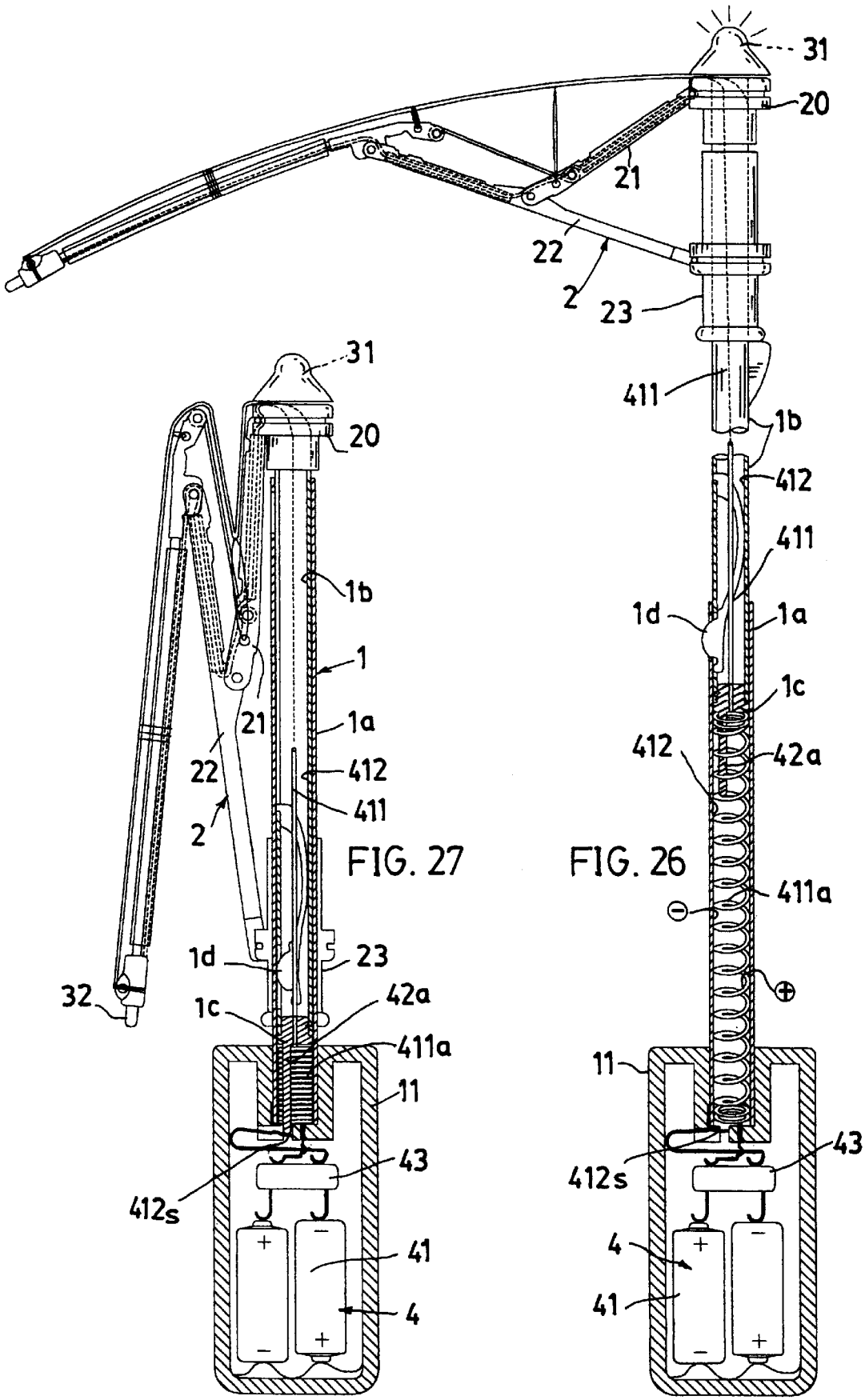
FIG. 26 shows further preferred embodiment of the present invention.
FIG. 27 shows the folded umbrella as closed from FIG. 26.

As shown in FIGS. 26, 27, the power supply circuit as aforementioned as shown in FIGS. 13, 14 has been modified to eliminate the on-off switch 42 as slidably held on the grip 11; and the on-off switch, now being simplified, includes: an actuating rod 42*a* protruding downwardly from a plug 1*c* retained on a bottom end of the upper tube 1*b* of the shaft 1, and a negative contactor 412*s* resiliently held in the grip 11 and normally contacted with a bottom end of the lower tube 1*a* of the shaft 1 for closing a negative pole of the power source 41 with the negative conductor 412 formed in situ on the lower tube 1*a* and the upper tube 1*b* of the shaft 1; whereby upon closing of the umbrella to lower the upper tube 1*b* down to the lower tube 1*a*, the actuating rod 42*a* will be downwardly extended to depress the negative contactor 412*s* to be separated from the negative conductor 412 of the shaft 1, thereby disconnecting the power source to the illuminators 31, 32; while opening the umbrella to extend the upper tube 1*b* from the lower tube 1*a*, the negative contactor 412*s* will be automatically resiliently restored to contact the negative conductor 412 to complete the power supply circuit to turn on the illuminators.

The present invention provides more selective power switching devices and electrical connection mechanisms to be much improved over the original application.

The present invention may be further modified without departing from the spirit and scope of this invention.

I claim:

1. An illuminating umbrella comprising:

a central shaft (1) having at least a lower tube (1*a*) and an upper tube (1*b*) telescopically engageable each other and having a grip (11) formed on a lower portion of said lower tube;

a rib assembly (2) for securing an umbrella cloth (5) thereon having a plurality of top ribs (21) each pivotally secured to an upper notch (20) fixed on a top portion of said shaft, and a plurality of stretcher ribs (22) each pivotally connected to each said top rib (21) and a runner (23) slidably held on said shaft, a plurality of outer ribs (24) each pivotally connected to each said stretcher rib (22), and a plurality of connecting ribs (25) each pivotally connected between each said outer rib (24) and each said top rib (21);

an illuminating means (3) including a top illuminator (31) secured on a top of said shaft, and a plurality of tip illuminators (32) each secured on a tip end of each said outer rib (24); and a power supply means (4) including a power source (41) of at least a battery stored in said grip, an on-off switch (42) formed on said grip for switching on or off said power source, a positive conducting ring (44) disposed on said upper notch (20) for electrically connecting a positive pole of each said illuminator through an externally insulated positive wire (P) and electrically connected to a positive pole of the power source (41) through a positive conductor means in said shaft, and a negative conducting ring (45) disposed on said upper notch (20) on said central shaft (1) for electrically connecting a negative pole of each said illuminator through an externally insulated negative wire (N) and electrically connected to a negative pole of said power source (41) through the on-off switch (42) and a negative conductor means in said shaft (1);

a flasher (43) connected between said illuminators and said power source for flashing said illuminators when said switch is switched on;

each said top rib (21) having an inner hole formed in an inner portion of the top rib for leading said positive and negative wires (P, N) from each said tip illuminator (32) and through a plurality of protective tubes (46, 46*a*, 46*b*) respectively coupled with each said outer rib (24), said stretcher rib (22), and said top rib (21) for continuously disposing said positive and negative wires in each said protective tube to be connected with said positive and negative conducting rings (44, 45) on said upper notch (20); and a cap means (31*a*) provided on a top of said central shaft (1) for encasing said top illuminator (31) therein and for shielding said positive and negative conducting rings (44, 45) therein and for fastening an inner portion (51) of the umbrella cloth (5) therein.

2. An illuminating umbrella according to claim 1, wherein each said illuminator is a light-emitting diode.

3. An illuminating umbrella according to claim 1, wherein each said tip illuminator (32) has said positive and negative wires (P, N) subsequently disposed in an outer protective tube (46) encasing the outer rib (24) therein, a middle protective tube (46*a*) clamped in said stretcher rib (22), and an inner protective tube (46*b*) clamped in said top rib (21).

4. An illuminating umbrella according to claim 1, wherein each said top rib (21) is bifurcated at an inner end portion of said top rib for forming said inner hole in the inner end portion of said top rib for leading the positive and negative wires (P, N) from said tip illuminator (32) towards said positive and negative conducting rings (44, 45) on said upper notch (20) by winding said positive and negative wires around a fastening wire (200), which is annularly fastened on the upper notch for pivotally securing the top ribs (21) on said upper notch (20).

5. An illuminating umbrella according to claim 1, wherein said illuminating means (3) further includes a grip illuminator (33) secured on said grip and electrically connected to said power source through said on-off switch.

6. An illuminating umbrella according to claim 1, wherein said positive conductor means includes a positive conductor (411) as externally insulated and connected with a coiled positive conductor (411*a*), which is externally insulated and telescopically wound in the lower tube (1*a*) of said shaft, with said coiled positive conductor (411*a*) electrically connected to the positive pole of said power source (41).

7. An illuminating umbrella according to claim 6, wherein said lower tube (1*a*) has a plug (1*c*) plugged in a lower end thereof for retaining an upper end of said coiled positive conductor (411*a*).

8. An illuminating umbrella according to claim 1, wherein said negative conductor means is formed in situ on said shaft (1), with the upper tube (1*b*) and the lower tube (1*a*) telescopically engageable and electrically conductive each other.

9. An illuminating umbrella according to claim 8, wherein said shaft (1) includes a coupling spring catch (1*d*) made of electrically conductive material and having an upper end (1*e*) secured to a lower portion of the upper tube (1*b*), and a lower hook end (1*f*) bent outwardly to contact the lower tube (1*a*) through a catch hole (1*h*) formed in the upper tube (1*b*) when the upper tube (1*b*) is upwardly extended and coupled with the lower tube (1*a*) when opening the umbrella as coupled by the coupling spring catch (1*d*) protruding outwardly through two catch holes (1*h*, 1*j*) respectively formed in the upper tube (1*b*) and the lower tube (1*a*), thereby ensuring a continuous electrical connection between the upper tube (1*b*) and the lower tube (1*a*) for completing the negative conductor means (412) as formed by the upper and the lower tubes (1*b*, 1*a*).

10. An illuminating umbrella according to claim 1, wherein said cap means (31*a*) as provided on a top of the shaft (1) includes: a transparent top cover (311) encasing the top illuminator (31) having an intermediate cap portion (312) protruding downwardly from the transparent top cover (311) and having a lower flange (312*f*) formed on a bottom portion of the cap portion (312); and a base member (313) secured on the shaft (1) and having a male-threaded portion (313*t*) engaged with a female-threaded portion (312*t*) of the cap portion (312) and having a bottom flange (313*f*) of the base member (313) engaged with an outer rim of the upper notch (20) for encasing the positive and negative conducting rings (44, 45) in between the upper notch (20) and the bottom flange (313*f*) of the base member (313), with the bottom flange (313*f*) of the base member (313) and the lower flange (312*f*) of the cap portion (312) cooperatively clamping an inner cloth portion (51) of the umbrella cloth (5) between said two flanges (313*f*, 312*f*) of the base member (313) and the cap portion (312) for enhancing water proof of the umbrella.

11. An illuminating umbrella according to claim 10, wherein said base member (313) with said bottom flange (313*f*) thereof is formed as a base washer (313*w*); and said female-threaded portion (312*t*) of the cap portion (312) engaged with a male-threaded portion (20*t*) formed on the upper notch (20).

12. An illuminating umbrella according to claim 1, wherein each said tip illuminator (32) has a pair of pins (32*p*) protruding from an illuminator base (320) to be plugged in a socket (321*s*) of a tip holder (321) and connected with the positive and negative wires (P, N) led from the protective tube (46) which encases the outer rib (24) therein; with the tip holder (321) coupled to an outer end portion (24*b*) of the outer rib (24) and with the tip holder (321) coupled to a tip sleeve (322) for further protecting the tip illuminator (32) and, said tip sleeve (322) having a top hole (322*e*) formed in a top portion of the tip sleeve for securing an outer portion (52) of the umbrella cloth (5) on the tip sleeve (322).

13. An illuminating umbrella according to claim 12, wherein said tip holder (321) includes: a rib hole (321*a*) formed in the tip holder (321) for inserting the outer end portion (24*b*) of the outer rib (24) into the rib hole (321*a*), a slot (321*h*) formed in the tip holder to be engaged with a rib lug (24L) formed on the outer rib (24), a holder lug (321L) formed on the tip holder (321) to be engaged with a sleeve slot (322*h*) formed in the tip sleeve (322), a flat portion (321*t*) longitudinally formed on a circumference of the tip holder (321) to be engaged with a secant through hole (322*f*) longitudinally formed through the tip sleeve (322) and a pair of grooves (321*g*) parallelly recessed in opposite sides of the tip holder (321) for embedding the positive and negative wires (P, N) in the two grooves as led from the protective tube (46); said tip sleeve (322) having the secant through hole (322*f*) engaged with the flat portion (321*t*) of the tip holder (321) and engaged with a flat edge portion formed on the illuminator base (320) of the tip illuminator (32) for preventing twisting of the tip illuminator, the tip holder and the tip sleeve when coupled together.

14. An illuminating umbrella according to claim 12, wherein said tip sleeve (322) has a transparent cover for encasing the tip illuminator.

15. An illuminating umbrella according to claim 1, wherein said positive conductor means includes a positive conductor (411) in an upper portion of said shaft (1) connected with a coiled positive conductor (411*a*) held in the lower tube (1*a*) of the shaft (1), and said negative conductor means including a negative conductor (412) as formed in an upper portion of the shaft (1) slidably contacted with a lower rod negative conductor (412*a*) electrically connected to the negative pole of the power source (41) through the on-off switch (42); and said negative conductor (412) and said lower rod negative conductor (412*a*) respectively covered with electrically insulative sheath (412*s*) thereon, having an electrically conductive top end portion formed on a top end of the lower rod negative conductor (412*a*) adjacent a top insulative head portion (412*i*) and electrically conducted with a hook end (412*c*) formed on a bottom end of the negative conductor (412) when the umbrella is opened and the upper tube (1*b*) of the shaft (1) is upwardly extended above and stably coupled with the lower tube (1*a*), thereby completing the electrical connection among the power source and the illuminators through the positive conductors (411, 411*a*) and the negative conductors (412, 412*a*).

16. An illuminating umbrella according to claim 1, wherein said upper notch (20) of said shaft (1) has a printed-circuit-board (PCB) disk (40) disposed on the upper notch (20) having at least a positive conducting ring (44*a*) concentrically formed on the PCB disk (40) for connecting a positive wire (P) of the tip illuminator (32), and having a negative conducting ring (45*a*) concentrically formed on the PCB disk (40) for connecting a negative wire (N) of the tip illuminator (32).

17. An illuminating umbrella according to claim 1, wherein said tip illuminators (32) include a plurality of groups of tip illuminators (32) flashed alternatively or sequentially, each said tip illuminator having a positive wire (P) electrically connected to a positive conducting ring annularly formed on a printed-circuit-board (PCB) disk (40) disposed on said upper notch (20), and a negative wire electrically connected to a negative conducting ring annularly formed on said PCB disk (40).

18. An illuminating umbrella according to claim 1, wherein said illuminating umbrella is an automatic umbrella having an opening spring (14) retained in the shaft (1) and a push button (13) depressible for opening the umbrella, in which the negative conductor means formed on said shaft, and said positive conductor means including a positive conductor (411) as externally insulated and slidably contacted with a lower rod positive conductor (411'*a*) which is externally insulated and is electrically connected to the positive pole of the power source (41), having a top hook end (411*c*) of the lower rod positive conductor (411'*a*) electrically contacted with an electrically conductive bottom end of the positive conductor (411) adjacent to a bottom insulative head portion (411*i*) formed on a bottom of the positive conductor (411).

19. An illuminating umbrella according to claim 1, wherein said on-off switch (42) includes: an actuating rod (42*a*) protruding downwardly from a plug (1*c*) retained on a bottom end of the upper tube (1*b*) of the shaft (1), and a negative contactor (412*s*) resiliently held in the grip (11) and normally contacted with a bottom end of the lower tube (1*a*) of the shaft (1) for closing a negative pole of the power source (41) with the negative conductor means formed in situ on the lower tube (1*a*) and the upper tube (1*b*) of the shaft (1); whereby upon closing of the umbrella to lower the upper tube (1*b*) down to the lower tube (1*a*), the actuating rod (42*a*) will be downwardly extended to depress the negative contactor (412*s*) to be separated from the negative conductor means of the shaft (1), thereby disconnecting the power source to the illuminators.

20. An illuminating umbrella comprising:

a central shaft (1) having a lower tube (1*a*) and an upper tube (1*b*) telescopically engageable each other, and having a grip formed on a lower portion of said shaft;

a rib assembly (2) for securing an umbrella cloth thereon having at least a plurality of top ribs (21) each pivotally secured to an upper notch (20) fixed on a top portion of said shaft (1), and a plurality of stretcher ribs (22) each pivotally connected to each said top rib and a runner slidably held on said shaft;

an illuminating means (3) including a top illuminator (31) secured on a top of said shaft, and a plurality of tip illuminators (32) each secured on a tip end of a rib of said rib assembly (2); and a power supply means (4) including a power source (41) of at least a battery stored in said grip, a positive conducting ring (44) disposed on said upper notch (20) for electrically connecting a positive pole of each said illuminator through an externally insulated positive wire (P) and electrically connected to a positive pole of the power source (41) through a positive conductor means in said shaft (1), and a negative conducting ring (45) disposed on said upper notch (20) on said central shaft (1) for electrically connecting a negative pole of each said illuminator through an externally insulated negative wire (N) and electrically connected to a negative pole of said power source (41) through a negative conductor means in said shaft (1);

a flasher (43) connected between said illuminators and said power source for flashing said illuminators when said switch is switched on;

each said top rib (21) having an inner hole formed in an inner portion of the top rib for leading said positive and negative wires (P, N) from each said tip illuminator to be connected with said positive and negative conducting rings (44, 45) on said upper notch (20); and a cap means **(31*a*) provided on a top of said central shaft (1) for encasing said top illuminator (31) therein and for shielding said positive and negative conducting rings (44, 45)** therein and for fastening an inner portion of the umbrella cloth therein;

said positive conductor means including a positive conductor (411) as externally insulated and slidably contacted with a lower rod positive conductor **(411'*a*) externally insulated, with a hook end (411*c*) formed on a bottom end of the positive conductor (411) electrically contacted with an electrically conductive top end of the lower rod positive conductor (411'*a*) adjacent a top insulative head portion (411*i*) formed on a top end of the lower rod positive conductor (411'*a*); said negative conductor (412) formed in situ on the shaft (1)**; whereby upon opening of the umbrella, a circuit of said power supply means including said positive and negative conductor means will be closed to light the illuminators.

* * * * *